US006755162B1

(12) United States Patent
Marriott

(10) Patent No.: US 6,755,162 B1
(45) Date of Patent: Jun. 29, 2004

(54) DISTRIBUTED ACCUMULATOR FOR HYDRAULIC CAMLESS VALVE ACTUATION SYSTEM

(75) Inventor: Craig D. Marriott, Clawson, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/403,206

(22) Filed: Mar. 31, 2003

(51) Int. Cl.[7] ..... F01L 9/02

(52) U.S. Cl. ..... 123/90.13; 123/90.12; 123/90.14

(58) Field of Search ..... 123/90.12, 90.13, 123/90.14, 90.15; 60/413, 453, 454, 469, 371

(56) References Cited

U.S. PATENT DOCUMENTS

| | | | | | |
|---|---|---|---|---|---|
| 3,926,159 | A | * | 12/1975 | Michelson et al. | 123/90.11 |
| 4,106,446 | A | * | 8/1978 | Yamada et al. | 123/90.13 |
| 4,174,687 | A | * | 11/1979 | Fuhrmann | 123/90.13 |
| 4,188,925 | A | * | 2/1980 | Jordan | 123/90.12 |
| 4,651,781 | A | | 3/1987 | Kandelman | |
| 4,897,906 | A | | 2/1990 | Bartholomew | |
| 5,617,827 | A | | 4/1997 | Eshleman et al. | |
| 5,709,248 | A | | 1/1998 | Goloff | |
| 6,009,906 | A | | 1/2000 | Salazar | |
| 6,109,304 | A | | 8/2000 | Wolf et al. | |
| 6,148,798 | A | | 11/2000 | Braun et al. | 123/467 |
| 6,418,909 | B2 | | 7/2002 | Rossi et al. | |
| 6,510,825 | B2 | * | 1/2003 | Cristiani et al. | 123/90.12 |
| 6,513,500 | B2 | | 2/2003 | Braun et al. | |
| 2003/0015155 | A1 | | 1/2003 | Turner et al. | |

* cited by examiner

*Primary Examiner*—Thomas Denion
*Assistant Examiner*—Jaime Corrigan
(74) *Attorney, Agent, or Firm*—Leslie C. Hodges

(57) ABSTRACT

A manifold is provided for housing high pressure oil on a camless engine. A body of the manifold has first, second and third channels formed therein lengthwise in the body. Switching valves on the body are operative to alternately communicate oil in the channels with cylinder valves of an engine to which the manifold is mounted to affect movement of the cylinder values. A distributed accumulator is positioned in at least one of the channels and includes at least one compliant pocket filled with a compressible fluid. The accumulator is configured such that the pocket attenuates pressure oscillations in the oil resulting from oil flow oscillations during actuation of the switching valves.

20 Claims, 3 Drawing Sheets

DISTRIBUTED ACCUMULATOR FOR HYDRAULIC CAMLESS VALVE ACTUATION SYSTEM

TECHNICAL FIELD

The present invention relates to a distributed accumulator for attenuating pressure oscillations in oil channels of a hydraulic valve actuation system.

BACKGROUND OF THE INVENTION

Internal combustion engines typically include intake and exhaust valves which are operated by cams on a camshaft associated with the engine. Camless engines with electrically or hydraulically controlled valves have been proposed to provide improved control of valve operation in order to achieve valve movement which does not depend upon the contours of a cam surface. For example, an electrically or hydraulically controlled engine may enable valves to open multiple times during an engine cycle, or not at all, such as in a cylinder deactivation system. Electrically or hydraulically controlled valves may make timing adjustment easier and provide fully flexible valve actuation control.

In a hydraulically controlled valvetrain, variations in hydraulic pressure within the oil supply, oil return and control passages may alter the performance of the valve train. If the pressure oscillations are too high in amplitude and/or not of consistent phase in relation to each valve event, valve position control may be lost. This may result in erratic valve train dynamics, valve train noise, and potential valve-to-piston interference or engine failure. Accordingly, it is desirable to attenuate such pressure oscillations.

SUMMARY OF THE INVENTION

The present invention provides a distributed accumulator for use in the oil supply, oil return, and/or control channels of a manifold for a hydraulic camless valve actuation system. The distributed accumulator is configured to attenuate pressure oscillations in the oil resulting from oil flow oscillations during actuation of switching valves.

More specifically, a manifold is provided for distributing high pressure oil on a camless engine. The manifold includes a body having first, second and third channels formed therein lengthwise in the body. Switching valves on the body are operative to alternately communicate oil in the channels with cylinder valves (via force translators) of an engine to which the manifold is mounted to affect movement of the cylinder valves. A distributed accumulator is positioned in one of the channels and includes at least one compliant pocket filled with a compressible fluid. The accumulator is configured such that the pocket attenuates pressure oscillations in the oil resulting from oil flow oscillations during actuation of the switching valves.

Preferably, the distributed accumulator is positioned in an oil return channel (the first channel), and a second distributed accumulator is positioned in the control channel (the second channel).

A plurality of compliant pockets may be spaced along the length of each distributed accumulator, or a single compliant pocket may extend substantially the length of each distributed accumulator.

Each distributed accumulator may also have a holder portion formed at an end thereof and having a contour matching the contour of the respective channel to secure the distributed accumulator within the respective channel.

Preferably, each pocket has a stainless steel membrane with a compressible fluid trapped therein. The compressible fluid may be an inert gas such as nitrogen or air, for example.

The invention also contemplates a camless engine including intake and exhaust valves controlled by oil pressure within manifolds as described above. The switching valves selectably communicate the high pressure or low pressure oil with the cylinder valve through a fluid aperture (via a force translator, for example) to affect movement of the cylinder valve between open and closed positions. In order to attenuate pressure oscillations and provide smooth valve closure, a distributed accumulator is positioned in at least one of the oil supply, oil return, and control channels of the manifold.

The above features and advantages, and other features and advantages of the present invention are readily apparent from the following detailed description for the best mode for carrying out the invention when taken in connection with the accompanying drawings.

DESCRIPTION OF THE PREFERRED EMBODIMENTS

Figure 1:
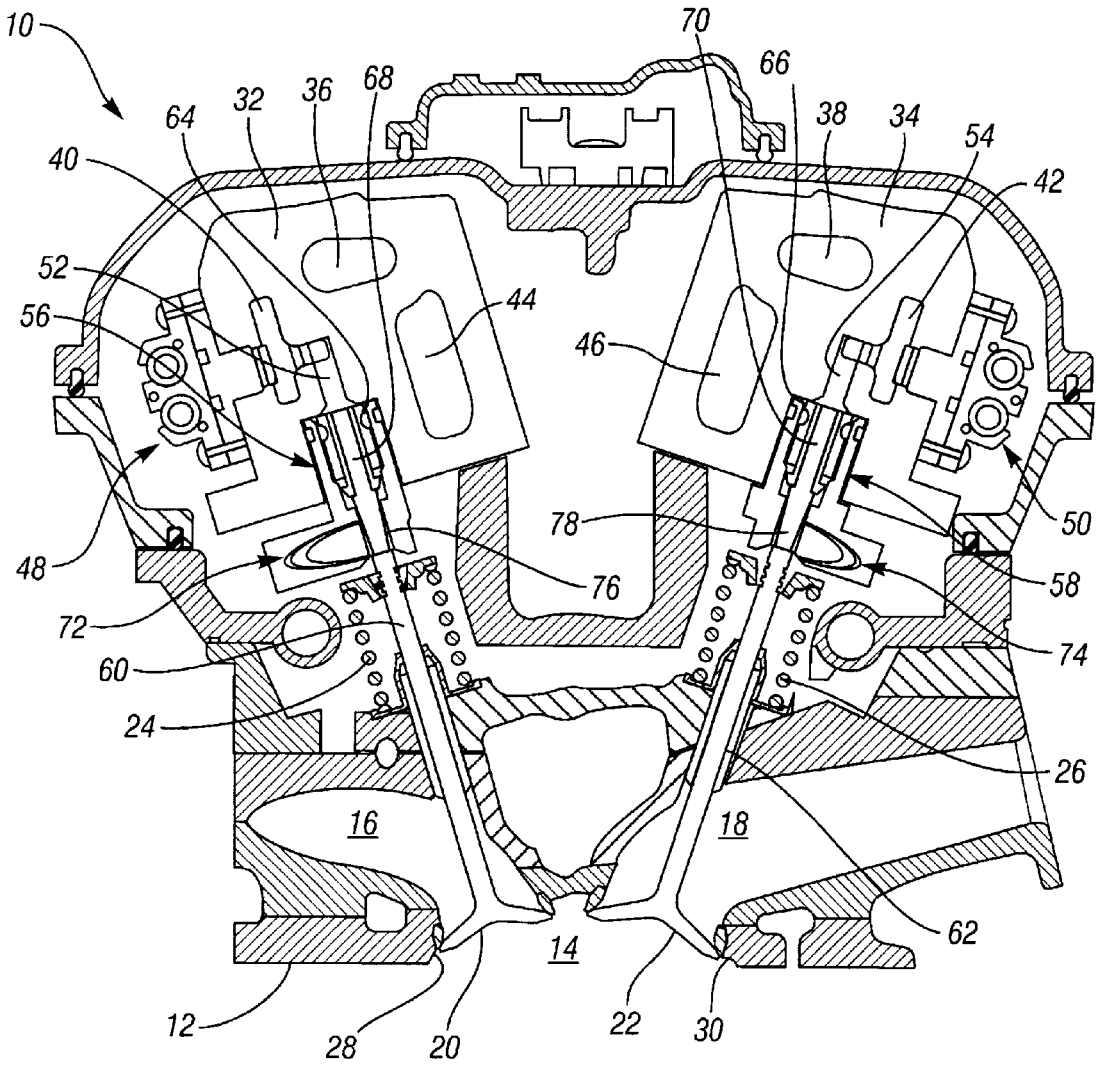
FIG. 1 shows a vertical cross-sectional view of camless engine in accordance with the invention.

Referring to FIG. 1, a vertical cross-sectional view of a camless engine 10 is shown in accordance with the present invention. The camless engine 10 includes a cylinder head 12 having a plurality of cylinders formed therein in communication with exhaust and intake ports 16, 18. The position of one such cylinder is identified with reference number 14 in FIG. 1, although the cylinder is not shown. The exhaust and intake ports 16, 18 are selectively communicated with the cylinder 14 by opening and closing the exhaust and intake valves (also referred to herein as cylinder valves) 20, 22.

The return springs 24, 26 bias the exhaust and intake valves 20, 22 toward a closed position against the respective valve seats 28, 30, respectively.

Typically, exhaust and intake valves are actuated by cams on a cam shaft. However, in the camless engine of the present invention, movement of the exhaust and intake valves 20, 22 against the force of the return springs 24, 26 is actuated hydraulically via high-pressure oil in the manifolds 32, 34. Each manifold 32, 34 includes a high-pressure channel 36, 38 for carrying oil at high pressure, such as 3,000 p.s.i. (20 MPa). The manifolds 32, 34 also each include a low-pressure channel 40, 42 for carrying oil at approximately 50 p.s.i. (350 kPa). The manifolds 32, 34 further include a control pressure channel 44, 46 for carrying oil at approximately 350 p.s.i. (2.5 MPa) for use in controlling the switching valves 48, 50.

The switching valves 48, 50 are operative to alternatively connect the high-pressure channels 36, 38 and low-pressure channels 40, 42 with the fluid apertures 52, 54 for actuating the valves 20, 22.

The switching valves 48, 50 selectively communicate the low-pressure and high-pressure channels 36, 38, 40, 42 with the fluid apertures 52, 54 in a manner to either overcome the force of the respective return springs 24, 26 to open the valves 20, 22, or to allow the return springs 24, 26 to return the respective valves 20, 22 to the closed position. The pressure in the control channels 44, 46 are used by the switching valves 48, 50 for controlling actuation.

A working description of the switching valves 48, 50 is provided in detail in the following patents assigned to Sturman Industries, which are incorporated by reference in their entirety herein: U.S. Pat. Nos. 5,829,396; 6,024,060; 6,308,690; 6,349,685; 6,354,185; and 6,360,728. The present invention may utilize the switching valve technology described in the above-referenced patents in a vehicle engine configured for mass production.

Force translators 56, 58 transmit force from the oil pressure within the fluid apertures 52, 54 to the stems 60, 62 of the exhaust and intake valves 20, 22.

The force translators 56, 58 each include a movable sleeve 64, 66 and a movable pin 68, 70 inside the respective sleeves 64, 66. When sufficient pressure is applied, the movable sleeves 64, 66 move with the respective movable pins 68, 70 until the sleeves 64, 66 bottom out against a stop surface and the pins 68, 70 continue to move. Sensors 72,74 read the tapered surfaces 76, 78 of the pins 68,70 to determine the vertical position of the pins for control purposes.

Figure 2:
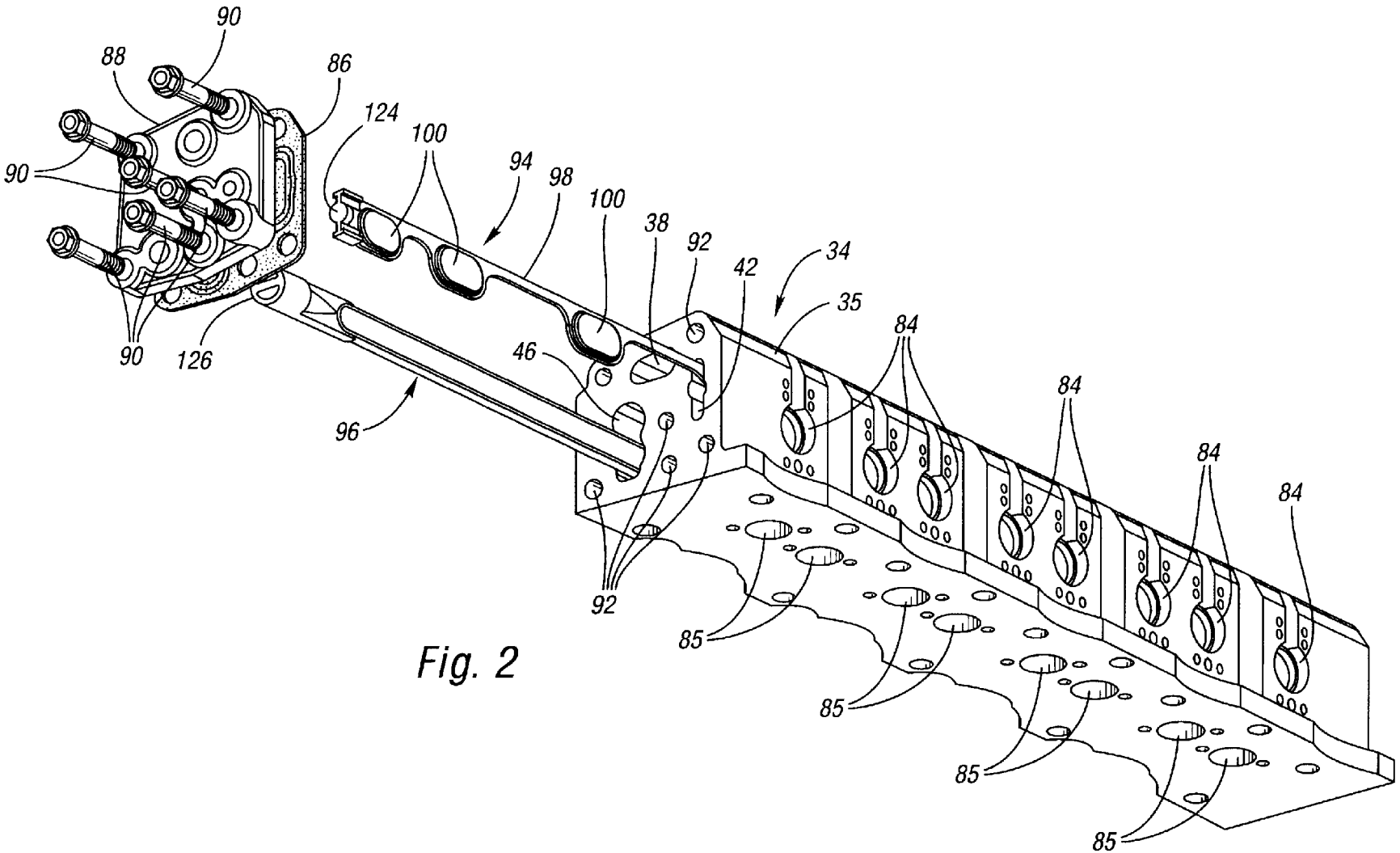
FIG. 2 shows an exploded perspective view of a manifold including distributed accumulators in accordance with the invention.
Figure 3:
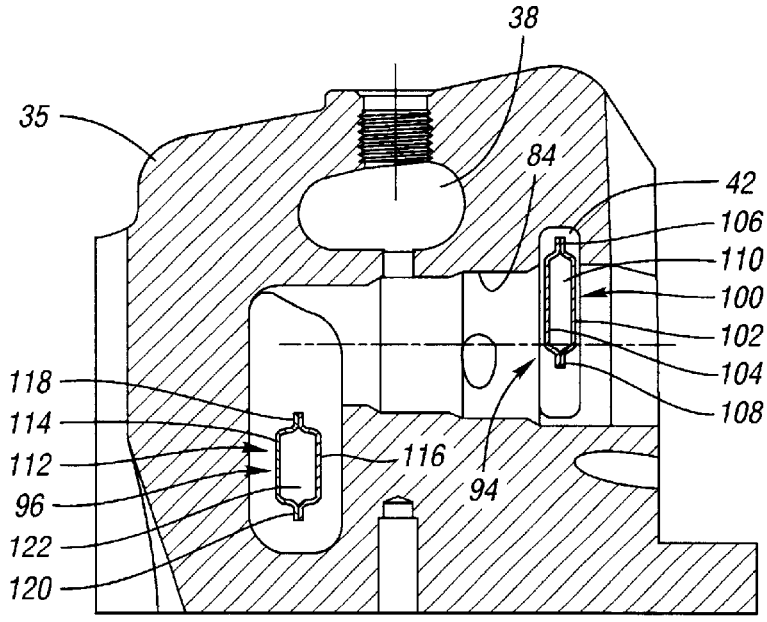
FIG. 3 shows a cross-sectional view of a manifold and accumulators in accordance with the invention.

Referring to FIGS. 2 and 3, a manifold 34 is shown having a body 35 with a high pressure supply channel 38, a low pressure return channel 42, and a control pressure channel 46 formed in the body 35. The body 35 also includes a plurality of switching valve mounting bores 84 formed therein to receive switching valves, such as the valve 50 shown in FIG. 1. The body 35 further includes valve actuator ports 85 which receive the force translators 58 shown in FIG. 1.

The manifold 34 also includes a gasket 86 and end plate 88 which are secured to the body 35 by the engagement of the bolts 90 with the bolt holes 92.

An alternative hydraulic valve actuation system which may be used with the present invention is shown in U.S. patent application U.S. Ser. No. 2003/0015155, which is hereby incorporated by reference in its entirety.

The invention is particularly characterized by the distributed accumulators 94, 96 which are positioned in the return channel 42 and control channel 46, respectively. The distributed accumulators 94, 96 provide a compliant-membrane or discrete series of membranes that contain a compressible fluid. These devices have the affect of reducing the apparent bulk modulus of oil in the channels, thereby reducing the sensitivity of pressure oscillations within the channels to flow oscillations during valve switching. Furthermore, due to the distributed nature of the device, i.e., due to the fact that the compliant membrane or discrete series of compliant membranes extend along the length of the channels or are spaced along the length of the channels, the pressure sensitivity to flow oscillations between a series of actuators or switching valves along these hydraulic passages is also reduced. As a result, the flow effects of one actuator or switching valve on a neighboring valve actuator or switching valve are minimized.

As the engine valves are actuated intermittently, hydraulic fluid is passed from the supply channel 38 to the return channel 42 through a proportioning valve. During these events, the instantaneous flow rate of the hydraulic pump of the system less the instantaneous flow rate of the valve actuators is continuously variable. As a result, the mass of fluid within each channel and between each actuator is also continuously variable. Since the hydraulic fluid has a relatively high bulk modulus and the volumes of the hydraulic fluid passages 42, 46 are essentially constant, the instantaneous fluctuation of fluid mass results in a related fluctuation of instantaneous hydraulic fluid pressure.

The distributed accumulators 94, 96 increase the instantaneous volume of the hydraulic passages 42, 46 as the mass of fluid and pressure increase, having the effect of reducing the bulk modulus (i.e., the pressure sensitivity) of the fluid. The volumes of the hydraulic passages 42, 46 are altered by reducing the volume of compressible fluid contained in the membranes of the accumulators 94, 96. Although the distributed accumulators 94, 96 are only partially visible in FIG. 2, the hidden portions are mirror images of the visible portions.

As shown in FIGS. 2 and 3, the distributed accumulator 94 has a body 98 with a discrete series of compliant pockets 100 which are spaced at intervals to avoid interference with components of the switching valves/actuators.

In the cross-sectional view of FIG. 3, it is shown that each pocket 100 is formed by first and second membranes 102, 104 which are welded together at the perimeter 106, 108 to form a hermetically sealed internal chamber 110 to receive a compressible fluid, such as an inert gas like nitrogen, air, helium, etc. The durable membranes 102, 104 are preferably stainless steel having a thickness of 0.008" (0.2 mm). Alternatively, the membranes 102, 104 may comprise other metals or elastomers.

The geometry of the membranes 102, 104 is optimally designed to produce a desired apparent bulk modulus of the fluid, while providing an absolute maximum volumetric distortion that is in excess of the normal fluid volumetric variations. In other words, the membranes 102, 104 are designed to be highly compliant, but preferably not to bottom out against each other under high pressure conditions. Also, preferably the yield strength of the membranes 102, 104 will not be exceeded during rogue operating conditions. Further, the spring rate of the membranes 102, 104 in connection with the compressibility of the fluid within the chamber 110 are selected to provide an overall compliance within a desired range. It may be desirable to design the geometry of the membranes 102, 104 to alter the load distribution through the membranes when the maximum expected volumetric flow variation and/or pressure is exceeded so that the membrane material never yields (i.e., the membranes 102, 104 would bottom out against each other before yielding).

FIG. 3 also shows the distributed accumulator 96 including pocket 112 which extends substantially the length of the accumulator 96 (as shown in FIG. 2). As shown, the membranes 114, 116 are welded together at the perimeter 118, 120 to form the internal chamber 122 which contains the compressible fluid, such as an inert gas as described above.

Because components of the switching valves/actuators may interfere with flow in the channels 42, 46, there is impeded communication of the pressure waves within the channels due to this interference, so the discrete or continuous accumulator pocket(s) reduce the sensitivity of the fluid between restrictions within the channels to flow and pressure oscillations thereby enabling improved control of the cylinder valves 20, 22. Because the pressure waves are attenuated in this manner, movement of the pins 66, 68 shown in FIG. 1, and therefore movement of the valves 20, 22 may be precisely, smoothly controlled, especially important during closing, to prevent noise and other operational problems, such as erratic valve train dynamics, valve-to-piston interference, or engine failure.

It is contemplated that the compressible fluid within the internal chambers 110, 122 may be pre-charged or pre-pressurized. This may be achieved by welding the membranes together inside a pressurized fluid filled chamber such that the pressurized fluid is trapped within the pockets when the membranes are welded together. Alternative methods include crimping, roll-forming, and extruding.

FIG. 2 also illustrates the holders 124, 126 which are provided at the ends of the respective distributed accumulators 94, 96. The holders 124, 126 each have a contour matching the contour of the respective channel 42, 46 to secure the distributed accumulator within the respective channel. The distributed accumulators 94, 96 are trapped within the channels 42, 46 by the gasket 86 and end plate 88.

It is contemplated that the distributed accumulators may be provided in one, two or all of the three channels 38, 42, 46. Because the supply channel 38 has the highest pressure, it is the least sensitive to pressure oscillations, therefore an accumulator is not provided therein in this particular embodiment.

Figure 4:
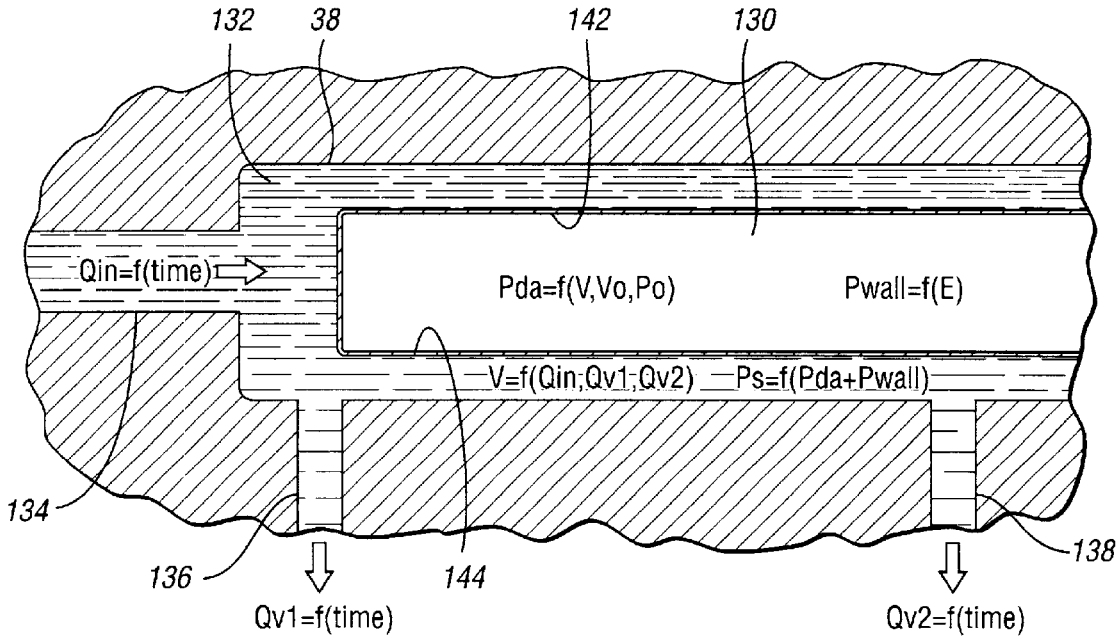
FIG. 4 is a schematic illustration of a distributed accumulator within a supply rail in accordance with the invention.

FIG. 4 schematically depicts a distributed accumulator 130 provided within the supply channel 38. As shown, the hydraulic fluid 132 is received in the supply channel 38 from a hydraulic pump at a flow Qin as a function of time (Qin=$f$(time)). The supply channel 38 receives the hydraulic fluid from the input channel 134, and the fluid is discharged through the output channels 136,138 when the appropriate switching valves are actuated. The flow through the valves is represented by Qv1=$f$(time) and Qv2=$f$(time). The distributed accumulator 130 includes a compressible fluid 140 therein having a fluid pressure acting against the membrane walls 142, 144 of the accumulator 130. This compressible fluid pressure Pda is a function of the volume V of the supply oil in the manifold, and the initial volume Vo and initial pressure Po of the compressible fluid 140. Accordingly, the pressure of the compressible fluid 140 against the membrane walls 142, 144;depends upon whether the compressible fluid is pre-charged. The spring rate of the membrane walls is also a factor. The resulting pressure of the walls is a function of Young's modulus of the membrane material of the walls. The volume (V) of the supply channel oil is therefore dependent upon the flow of fluid entering the channel (Qin), and the flow exiting the channel Qv1, Qv2. The resulting pressure of oil in the supply rail (Ps) is therefore a function of the compressible fluid pressure (Pda) and the pressure due to the Young's modulus of the membrane material (Pwall). Accordingly, the characteristics of the compressible fluid 140 and the membranes 142, 144 may directly attenuate oil pressure oscillations within the channel 38.

The invention accordingly provides a cost effective and packaging efficient means of providing the pressure attenuation needed for acceptable valve control by isolating pressure waves and reducing amplitude thereof.

While the best mode for carrying out the invention has been described in detail, those familiar with the art to which this invention relates will recognize various alternative designs and embodiments for practicing the invention within the scope of the appended claims.

What is claimed is:

1. A manifold for housing pressurized oil on a camless engine, comprising:

a body having first, second and third channels formed therein lengthwise in the body;

switching valves on the body operatively associated with said channels and with cylinder valves of an engine to which the manifold is mounted to affect movement of the cylinder valves; and a distributed accumulator positioned in one of said channels and including at least one compliant pocket filled with a compressible fluid, said accumulator being configured such that said at least one pocket attenuates pressure oscillations in the oil resulting from oil flow oscillations during actuation of said switching valves.

2. The manifold of claim 1, wherein said first channel comprises an oil return channel, and said distributed accumulator is positioned in the oil return channel.

3. The manifold of claim 2, wherein said second channel is a control channel, and the manifold further comprises a second distributed accumulator in the control channel.

4. The manifold of claim 1, wherein said at least one compliant pocket comprises a plurality of compliant pockets spaced along the length of the distributed accumulator.

5. The manifold of claim 1, wherein said at least one compliant pocket comprises a single compliant pocket extending substantially the length of the distributed accumulator.

6. The manifold of claim 1, wherein said distributed accumulator further comprises a holder formed at an end thereof and having a contour matching the contour of the respective channel to secure the distributed accumulator within the respective channel.

7. The manifold of claim 1, wherein said at least one pocket comprises a stainless steel membrane, and said compressible fluid comprises an inert gas.

8. The manifold of claim 7, wherein said inert gas is nitrogen.

9. The manifold of claim 7, wherein said inert gas is air.

10. A manifold for housing pressurized oil on a camless engine, comprising:

a body having a supply channel, a return channel and a control channel formed lengthwise in the body;

switching valves on the body operatively associated with said channels and with cylinder valves of an engine to which the manifold is mounted to affect movement of the cylinder valves;

a first distributed accumulator positioned in the return channel, and a second distributed accumulator positioned in the control channel, said accumulators each including at least one compliant pocket filled with a compressible fluid, and said accumulators being configured such that said at least one pocket of each accumulator attenuates pressure oscillations in the oil resulting from oil flow oscillations during actuation of said switching valves.

11. The manifold of claim 10, wherein said at least one compliant pocket comprises a plurality of compliant pockets spaced along the length of each distributed accumulator.

12. The manifold of claim 11, wherein said at least one compliant pocket comprises a single compliant pocket extending substantially the length of the respective distributed accumulator.

13. The manifold of claim 10, wherein each said distributed accumulator further comprises a holder formed at an end thereof and having a contour matching the contour of the respective channel to secure the distributed accumulator within the respective channel.

14. The manifold of claim 10, wherein said at least one pocket comprises a stainless steel membrane, and said compressible fluid comprises an inert gas.

15. The manifold of claim 14, wherein said inert gas is nitrogen.

16. The manifold of claim 14, wherein said inert gas is air.

17. A camless engine comprising:

a cylinder valve operatively associated with an engine cylinder and having a return spring biasing the cylinder valve toward a closed position;

a manifold body having a supply channel, a return channel, and a control channel therein;

said body having a plurality of switching valve mounting bores configured to receive a plurality of switching valves operative to alternately communicate oil in the supply channel and return channel with the cylinder valve to affect movement of the cylinder valve; and a first distributed accumulator positioned in the return channel, and a second distributed accumulator positioned in the control channel, said distributed accumulators each including at least one compliant pocket filled with a compressible fluid for attenuating pressure oscillations in the oil resulting from oil flow oscillations during actuation of the switching valves.

18. The camless engine of claim 17, wherein said at least one compliant pocket comprises a plurality of compliant pockets spaced along the length of the respective distributed accumulator.

19. The camless engine of claim 17, wherein said at least one compliant pocket comprises a single compliant pocket extending substantially the length of the respective distributed accumulator.

20. The camless engine of claim 17, wherein said at least one pocket comprises a stainless steel membrane, and said compressible fluid comprises an inert gas.

* * * * *